US007037086B2

(12) United States Patent
Irvine

(10) Patent No.: US 7,037,086 B2
(45) Date of Patent: May 2, 2006

(54) SELF-PRIMING CENTRIFUGAL PUMP

(75) Inventor: James A. Irvine, Suffolk (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/903,504

(22) Filed: Jul. 30, 2004

(65) Prior Publication Data

US 2005/0111990 A1 May 26, 2005

(30) Foreign Application Priority Data

Aug. 4, 2003 (GB) ..... 0318225

(51) Int. Cl.
*F04B 23/08* (2006.01)

(52) U.S. Cl. ..... 417/199.2; 417/204

(58) Field of Classification Search ..... 417/200, 417/201, 204, 199.2
See application file for complete search history.

(56) References Cited

U.S. PATENT DOCUMENTS 2,292,896 A * 8/1942 Morgan ..... 417/199.2
3,578,880 A 5/1971 Cygnor
3,644,061 A 2/1972 McFarlin
3,811,797 A * 5/1974 Lewis ..... 417/199.2
4,013,053 A * 3/1977 Dinkelkamp et al. .... 417/199.2
4,035,104 A 7/1977 Buse
6,409,478 B1 * 6/2002 Carnes et al. ..... 417/200

FOREIGN PATENT DOCUMENTS

| | | |
|---|---|---|
| GB | 431237 | 7/1935 |
| GB | 804265 | 11/1958 |
| GB | 918798 | 2/1963 |
| GB | 2219958 | 12/1989 |
| JP | 1203751 | 8/1989 |

* cited by examiner

*Primary Examiner*—Michael Koczo, Jr.
(74) *Attorney, Agent, or Firm*—Ware Fressola Van Der Sluys & Adolphson LLP

(57) ABSTRACT

A self-priming centrifugal pump comprises an inlet and an outlet, and a centrifugal impeller for receiving liquid from the inlet and delivering it to the outlet. An inlet valve and an outlet valve are provided, and a diaphragm arrangement is driven by the same motor as the impeller to provide priming. The diaphragm arrangement can be integrated into a pump design without taking up significant additional space. By driving the diaphragm arrangement with the motor, no additional power source is required.

10 Claims, 4 Drawing Sheets

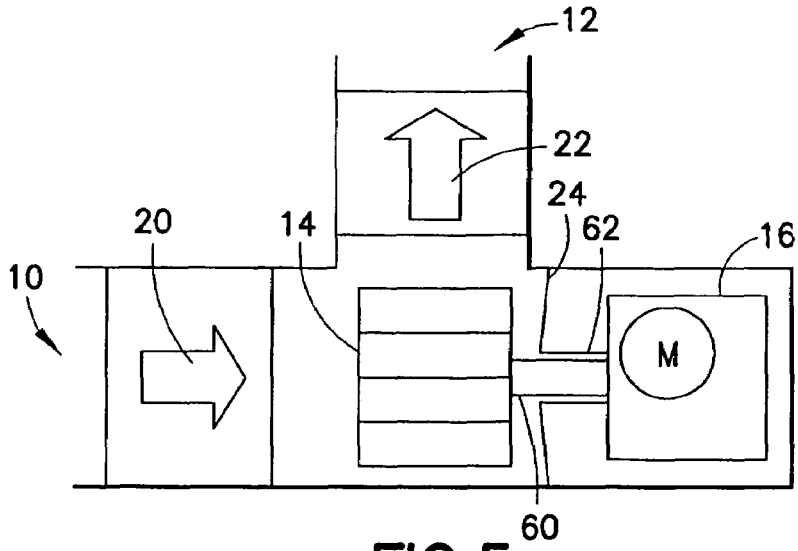
FIG.5
FIG.6
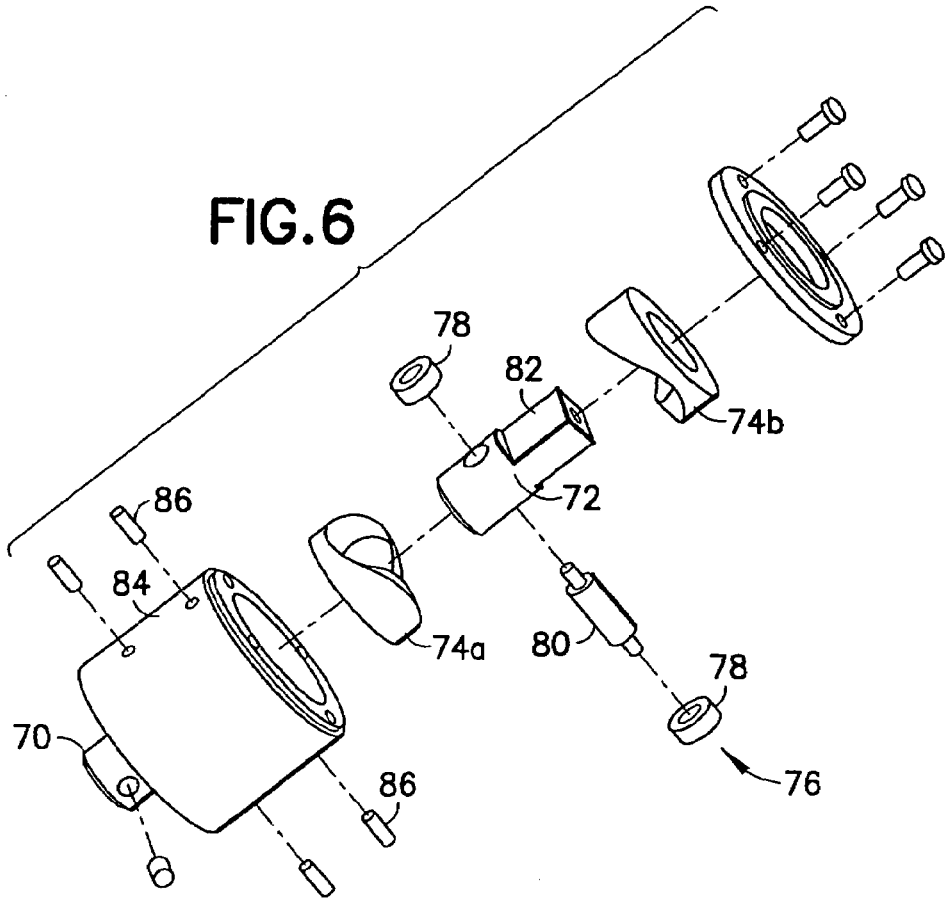

SELF-PRIMING CENTRIFUGAL PUMP

FIELD OF THE INVENTION

The present invention relates to centrifugal pumps and more particularly to a self-priming centrifugal pump.

BACKGROUND OF THE INVENTION

A basic centrifugal pump is not self-priming, and various self-priming centrifugal pumps have been developed.

Most commonly, a self-priming centrifugal pump is provided with a discharge tank contained in the pump housing and connected to recirculate liquid through the pumping chamber for priming. These tanks are initially provided with a supply of the liquid to be pumped and, during priming, the pump impeller is rotatably driven to recirculate liquid from the tank through the pumping chamber, so that gas in the pumping chamber becomes entrained with the recirculated liquid.

In other designs, an additional external pump is provided simply for priming, for example a liquid piston pump functioning as a priming wheel.

There is still a need for a self-priming centrifugal pump in which the priming arrangement takes up a small amount of space and also does not reduce significantly the efficiency of the pump.

SUMMARY OF THE INVENTION

According to the invention, there is provided a self-priming centrifugal pump comprising:

an inlet and an outlet; and a centrifugal impeller for receiving liquid from the inlet and delivering it to the outlet, the impeller being driven by a motor, wherein the pump further comprises:

an inlet valve and an outlet valve; and a diaphragm arrangement, the diaphragm arrangement being driven by the motor to provide priming.

A diaphragm arrangement can be integrated into a pump design without taking up significant additional space. By driving the diaphragm arrangement with the motor, no additional power source is required.

Preferably, the impeller is rotated about an output shaft of the motor, and the diaphragm arrangement is driven for reciprocating movement parallel to the output shaft. This reciprocating movement provides a pumping operation, in combination with the inlet and outlet valves, and which is suitable for priming the centrifugal pump.

Means is preferably provided for converting rotation of the output shaft into reciprocating movement for driving the diaphragm.

In one arrangement, the means for converting comprises a pair of cam wheels rotating about the output shaft, at least one diaphragm drive element being sandwiched between the cam wheels, the drive element being coupled to an associated diaphragm. Preferably, a fixed distance is provided between the profiles of the faces of the cam wheels which face each other. A fixed sized drive element can then be mounted between the cam wheels, and rotation of the cam wheels causes the drive element to move backwards and forwards parallel to the axis of the output shaft.

A plurality of diaphragm drive elements can be provided, and a plurality of associated diaphragms can be mounted in a carrier, the carrier being mounted around the output shaft but not rotating with the output shaft. This arrangement enables a diaphragm carrier to be mounted around the output shaft at a fixed axial position. This makes sealing of the diaphragm carrier around the output shaft easier. The diaphragms can then be provided in a circle around the central axis, and they are controlled (synchronously) by the drive elements.

The speed of rotation of the output shaft will determine the speed of oscillation of the diaphragms. A compromise thus needs to be found between the rotational speed of the centrifugal impeller and the oscillation speed of the diaphragms. If this compromise cannot be found, the output shaft of the motor can comprise first and second shaft members, a first shaft member for rotating the impeller at a first angular speed, and a second shaft member for rotating the cam wheels at a second, lower, angular speed. These first and second shaft members may be concentric about a common axis.

In another arrangement, the means for converting comprises a diaphragm drive shaft slidable axially with respect to the motor output shaft and an annular cam member mounted around the diaphragm drive shaft and defining a cam channel which varies in axial position around the annular cam member. The cam member rotates with respect to the diaphragm drive shaft, and a linkage is provided for fixing the axial position of the diaphragm drive shaft with respect to the cam channel.

This arrangement converts angular rotation into reciprocal motion by making the diaphragm drive shaft follow an annular channel which traces a path which moves parallel to the axis of the motor output shaft as well as around the axis of the shaft.

Again, the output shaft of the motor may comprise first and second shaft members, a first shaft member for rotating the impeller at a first angular speed, and a second shaft member for rotating the cam member with respect to the diaphragm drive shaft at a second, lower, angular speed. The second shaft member may be provided with a clutch, so that the means for converting can turned on or off. Thus, after priming, minimum motor output power is lost to the diaphragm arrangement. The clutch can operate automatically in dependence on the direction of rotation, so that priming is carried out by driving the motor in one direction, and pumping is carried out by driving the motor in the opposite direction.

It can be seen that invention can use a device for converting angular rotation into linear reciprocating movement, comprising:

a rotary input shaft having a rotational axis;

an output shaft slidable axially with respect to the input shaft;

an annular cam member mounted around the output shaft and defining a cam channel which varies in axial position around the annular cam member, the cam member rotating with respect to the output shaft;

a linkage for fixing the axial position of the output shaft with respect to the cam channel.

This arrangement enables an input shaft and an output shaft to be on the same axis, so that the arrangement takes up a minimum amount of space around the input and output shafts. Thus, a compact design is provided.

One of the cam member and the output shaft is mounted so that it cannot rotate, for example the output shaft. The cam member may comprise an annular ring having the cam channel formed in the outer surface of the ring, or else it may comprise first and second annular rings, one end face of each of the rings being shaped such that when mounted together, the cam channel is defined as a space between the end faces.

BRIEF DESCRIPTION OF THE DRAWINGS

Examples of the invention will now be described in detail with reference to the accompanying drawings, in which:

FIG. 5 shows schematically a third example of pump of the invention; and

FIG. 6 shows a device of the invention for converting rotation into reciprocal motion, and which may be used in the pumps of the invention.

DETAILED DESCRIPTION

Figure 1:
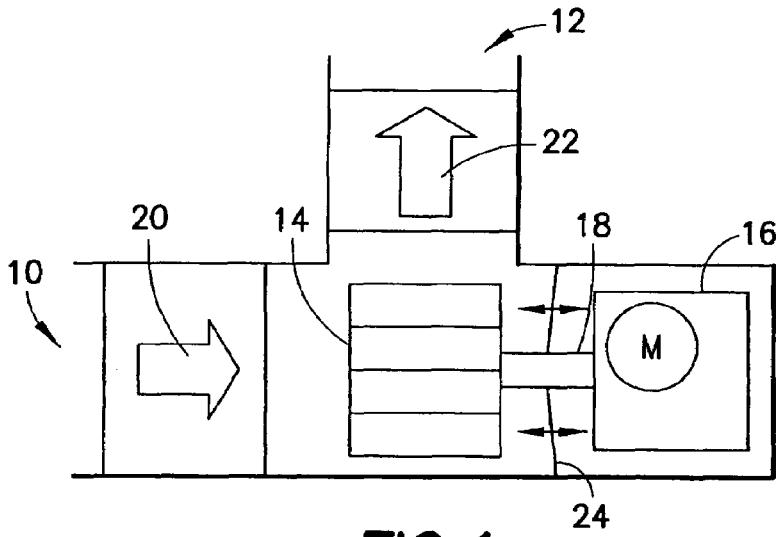
FIG. 1 shows schematically a first example of pump of the invention.

FIG. 1 shows schematically a first pump arrangement of the invention. The pump has an inlet 10 and an outlet 12, and a centrifugal impeller 14 for receiving liquid from the inlet and delivering it to the outlet. The impeller 14 is driven by a motor 16 about an output shaft 18 of the motor which is parallel to the direction of fluid intake. The fluid is expelled by the pump perpendicularly, in conventional manner.

In accordance with the invention, an inlet valve 20 and an outlet valve 22 are provided, and these cooperate with a diaphragm 24. The diaphragm 24 is driven by the motor 16 to provide priming and oscillates in reciprocal manner parallel to the shaft 18 to provide the priming operation. The diaphragm can be integrated into the housing without taking up significant additional space and uses relatively little power.

The pump includes an arrangement for converting rotation of the output shaft 18 into reciprocating movement for driving the diaphragm 24. This is not shown in detail in FIG. 1.

FIG. 1 shows schematically the diaphragm sealing with the outer casing of the pump at its outer edge and fixed axially at the outer edge. An inner opening in the diaphragm seals around the shaft 18 and moves backwards and forwards. The diaphragm does not rotate with the shaft, so that the interface between the inner opening of the diaphragm 24 and the shaft 18 must provide sealing for both rotational and sliding movement of the diaphragm relatively to the shaft.

The impeller 14 does not seal within the pump casing so that gas can pass around the impeller to the diaphragm.

Figure 2:
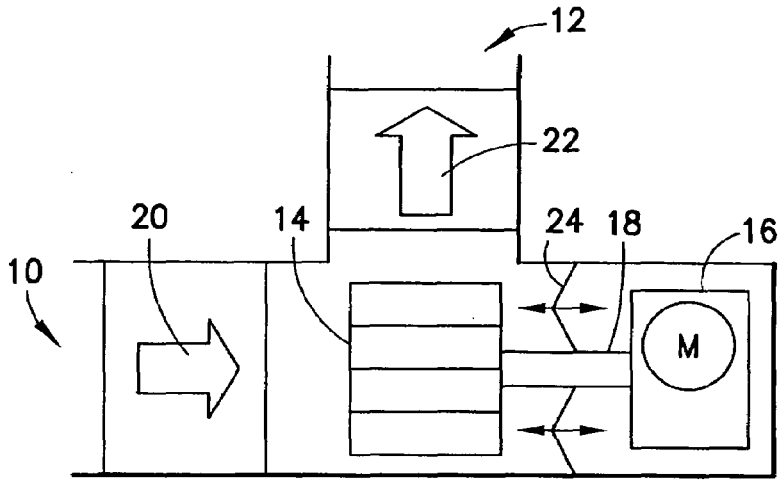
FIG. 2 shows schematically a second example of pump of the invention.

In the alternative arrangement of FIG. 2, the part of the diaphragm 24 around the shaft 18 is fixed in position axially, and the movement of the diaphragm is at a position radially between the shaft 18 and the outer casing of the pump.

Figure 3:
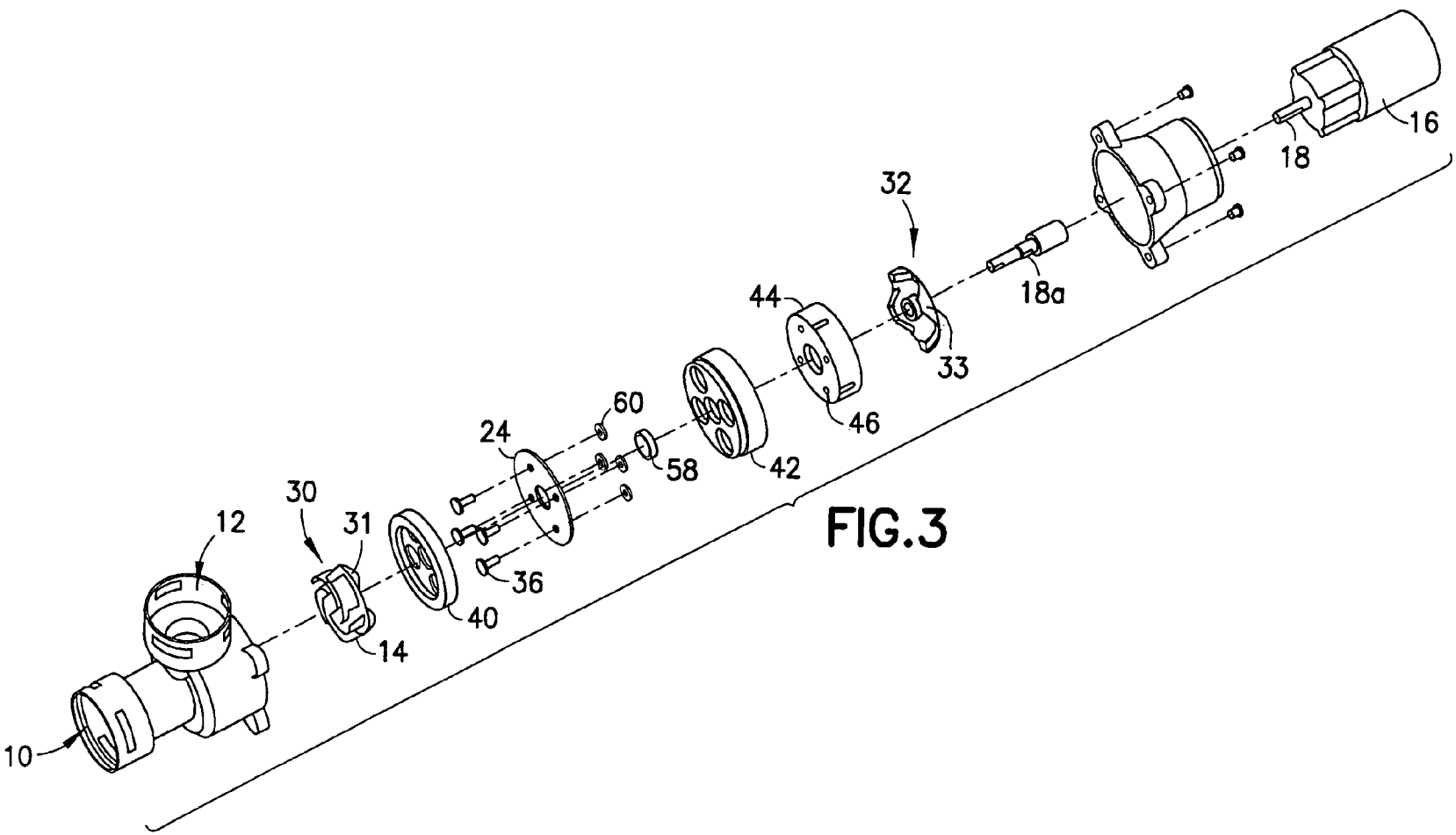
FIG. 3 shows in detail the components of an implementation of the pump of FIG. 2.

An exploded view of a detailed design providing the function of FIG. 2 is shown in FIG. 3.

In the arrangement of FIG. 3, the means for converting rotation of the output shaft 18 of the motor 16 comprises a pair of cam wheels 30, 32. Each of these cam wheels comprises a substantially flat plate which rotates about the output shaft 18 (or an extension piece 18a). The two cam members face each other and have lobes 31, 33 on their inner faces. The lobes in one of the cam members are aligned with the recesses between lobes in the other, so that a fixed distance is provided between the profiles of the faces of the cam wheels which face each other.

In the example of FIG. 3, there are four cam lobes disposed around the periphery of each cam wheel 30,32. Four drive pins 36 are sandwiched between the cam wheels, and as the cam wheels rotate, these pins move forwards and backwards parallel to the axis of the motor output shaft 18. The drive pins 36 are rotationally fixed as will become clearer below.

The diaphragm arrangement 24 is positioned between the cam wheels, and each drive pin 36 is for driving an associated diaphragm.

The diaphragm is held between members 40, 42 and an end plate 44 is provided having openings 46 which ensure the stability of the drive pins 36 as they move backwards and forwards. In practice, the elements 24,40,42,44 can be a single moulded article, for example a two-shot moulded article. A rigid plastic is used for most of the article, and a more flexible plastic is used for the deformable membrane parts of the diaphragm arrangement.

The diaphragm ring 24 seals with the inside of the pump casing. In addition, the members 40, 42 are a tight fit in the pump casing, so that none of these components are able to rotate. The cam wheels 30, 32 are rotationally keyed to the output shaft 18 (or 18*a*) so that they rotate with the motor output and cause the pins 36 to move backwards and forwards.

Figure 4:
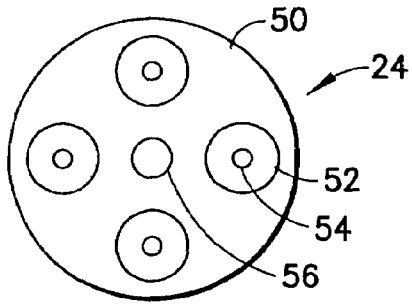
FIG. 4 shows in greater detail one of the components used in the pump of FIG. 3.

FIG. 4 shows in greater detail the diaphragm arrangement 24. It comprises a rigid ring 50 into which are moulded flexible individual diaphragms 52 each having an opening 54 for engaging with an associated drive pin 36. The drive pin may have a nut 60 and thread for clamping the pin to the diaphragm 52. A central opening 56 allows the passage of the motor shaft 18, and a lip seal 58 (shown in FIG. 3) is mounted within the opening 56 around the output shaft 18.

The ring 50 is thus mounted a fixed axial position along the shaft 18, and this makes sealing of the ring around the output shaft easier. The diaphragms 52 are provided in a circle around the central axis, and they are controlled (synchronously) by the drive pins, so that they all pump in parallel.

As shown in FIG. 3, the overall pump dimensions are kept to a minimum, for example by having the centrifugal impeller 14 and one of the cam wheels 30 defined as a single body.

The pump arrangement of FIG. 3 is also easy to assemble. The first cam wheel 32 is placed over the motor output shaft 18 (or 18*a*), then the diaphragm arrangement—which may be a single two-shot moulded article combining parts 40,24, 42,44—is placed over the top. The drive pins 36 and central lip seal will already be assembled to the diaphragm arrangement. The second cam wheel 30 is then placed over the top, and the keying with the shaft 18 (or 18*a*) will ensure that it adopts the correct orientation. Finally, the housing with the valves is placed over the top.

Figure 3A:
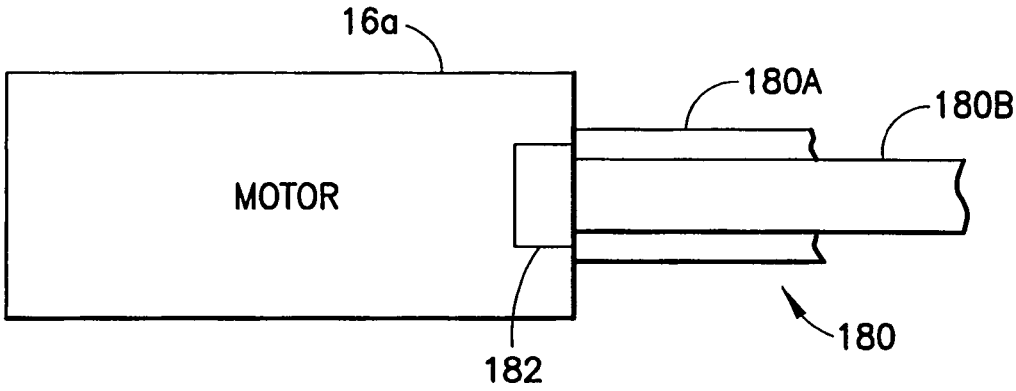
FIG. 3A shows an alternative embodiment of the pump.

The speed of rotation of the output shaft 18 will determine the speed of oscillation of the diaphragms 52. A compromise thus needs to be found between the rotational speed of the centrifugal impeller 14 and the oscillation speed of the diaphragms 52. If this compromise cannot be found, the output shaft generally indicated as 180 of the motor 16*a* can comprise first and second shaft members 180A, 180B, a first shaft member 180A for rotating the impeller like 14 (see FIG. 3) at a first angular speed, and a second shaft member 180B for rotating the cam wheels like 30 (see FIG. 3) at a second, lower, angular speed, as shown in FIG. 3A.

This arrangement is shown schematically in FIG. 5. An inner output shaft 60 extends to the centrifugal impeller 14 and an outer shaft 62 is used for driving the diaphragm 24.

By enabling the centrifugal pump to be driven at a different rotational speed to the diaphragm, the operation of each can be optimised.

One way of generating reciprocal motion from a rotational input has been described above. Other arrangements may be used, and FIG. 6 shows a device of the invention for this purpose.

The device has a rotary input shaft 70, which is connected to the output shaft of the motor in the pump. An output shaft 72 is slidable axially with respect to the input shaft, for example they may be separate components with a space between them. The input and output shafts 70, 72 are aligned on the same axis, providing a compact arrangement. An annular cam member 74*a*, 74*b* is mounted around the output shaft 72 and defines a cam channel which varies in axial position around the annular cam member. The cam members 74*a*, 74*b* rotate with respect to the output shaft 72. A linkage 76 is provided for fixing the axial position of the output shaft 72 with respect to the cam channel.

The linkage 76 comprises two wheels 78 on the ends of an axle 80.

As the cam members 74*a*, 74*b* rotate, the wheels 78 follow the channel defined between the cam members 74*a*, 74*b*. The wheels 78 thus move backwards and forwards, and this movement is transferred to the output shaft 72. The shaft 72 cannot rotate, for example rotation is prevented by the device to which the output shaft 72 is connected by the shaped end 82.

Thus, the input shaft 70 rotates the housing 84, which causes rotation of the cam members 74*a*, 74*b* by virtue of the coupling pins 86 which engage in slots in the cam members 74*a*, 74*b*.

Although a two-piece cam member is shown, it may be a single component with a channel formed for receiving a drive pin. Relative rotation between the drive pin and the cam member will then cause relative axial movement.

The reciprocating movement of the output shaft 72 can then be used in a pump of the invention to drive the diaphragm. For example, the arrangement of FIG. 6 may provide the outer shaft 62 of FIG. 5, and the inner shaft 60 may pass through the arrangement of FIG. 6, through a bore on the central axis and which passes through the shafts 70, 72. This central bore is not shown in FIG. 6.

In the designs above, the diaphragm is operated at all times when the motor is running. Whilst the operation of the diaphragm will not interfere with the operation of the centrifugal pump, it may reduce efficiency slightly.

In a modification to the arrangement of FIG. 5, a clutch 182 (see FIG. 3A) can be provided in the path of the outer shaft 62. Thus, after priming, the diaphragm can be turned off, and minimum motor output power is lost to the diaphragm arrangement. The clutch can operate automatically in dependence on the direction of rotation, so that priming is carried out by driving the motor in one direction (with the centrifugal impeller operating in reverse), and pumping is carried out by driving the motor in the opposite direction.

Any suitable valves 20,22 may be used, for example vane valves. The pump of the invention is suitable for any liquid, including liquids carrying some solid matter. It is well known that centrifugal pumps are suitable for pumping liquids with solid matter, for example for use in electrically pumped toilets, for example for marine applications.

The invention claimed is:

1. A self-priming centrifugal pump comprising:

an inlet and an outlet; and a centrifugal impeller for receiving liquid from the inlet and delivering it to the outlet, the impeller being driven by a motor and rotated about an output shaft of the motor, wherein the pump further comprises:

an inlet valve and an outlet valve;

a diaphragm arrangement driven for reciprocating movement parallel to the output shaft, the diaphragm arrangement being driven by the motor to provide priming; and a pair of cam wheels for converting rotation of the output shaft into reciprocating movement for driving the diaphragm, the pair of cam wheels rotating about the output shaft, at least one diaphragm drive element sandwiched between the cam wheels, the drive element being coupled to an associated diaphragm.

2. A pump as claimed in claim 1, wherein a plurality of diaphragm drive elements are provided, and wherein a plurality of associated diaphragms are mounted in a carrier, the carrier being mounted around the output shaft but not rotating with the output shaft.

3. A pump as claimed in claim 1, wherein the output shaft of the motor comprises first and second shaft members, a first shaft member for rotating the impeller at a first angular speed, and a second shaft member for rotating the cam wheels at a second, lower, angular speed.

4. A pump as claimed in claim 3, wherein the first and second shaft members are concentric about a common axis.

5. A self-priming centrifugal pump comprising:

an inlet and an outlet; and a centrifugal impeller for receiving liquid from the inlet and delivering it to the outlet, the impeller being driven by a motor and rotated about an output shaft of the motor, wherein the pump further comprises:

an inlet valve and an outlet valve;

a diaphragm arrangement driven f or reciprocating movement parallel to the output shaft, the diaphragm arrangement being driven by the motor to provide priming and comprising a diaphragm drive shaft slidable axially with respect to the motor output shaft;

an annular cam member mounted around the diaphragm drive shaft and defining a cam channel which varies in axial position around the annular cam member, the cam member rotating with respect to the diaphragm drive shaft; and a linkage for fixing the axial position of the diaphragm drive shaft with respect to the cam channel.

6. A pump as claimed in claim 5, wherein the output shaft of the motor comprises first and second shaft members, a first shaft member for rotating the impeller at a first angular speed, and a second shaft member for rotating the cam member with respect to the diaphragm drive shaft at a second, lower, angular speed.

7. A pump as claimed in claim 6, wherein the first and second shaft members are concentric about a common axis.

8. A pump as claimed in claim 6, wherein the second shaft member is provided with a clutch, so that the means for converting can turned on or off.

9. A pump as claimed in claim 8, wherein the clutch operates automatically in dependence on the direction of rotation.

10. A pump as claimed in claim 1, wherein the inlet and outlet valves comprise vane valves.

* * * * *